US011203896B2

(12) United States Patent
Jaskiewicz

(10) Patent No.: US 11,203,896 B2
(45) Date of Patent: Dec. 21, 2021

(54) ENTRYWAY AND WEATHER STRIP FOR THE SAME

(71) Applicant: Endura Products, LLC, Colfax, NC (US)

(72) Inventor: Tomasz Jaskiewicz, Oak Ridge, NC (US)

(73) Assignee: Endura Products, LLC, Colfax, NC (US)

( * ) Notice: Subject to any disclaimer, the term of this patent is extended or adjusted under 35 U.S.C. 154(b) by 157 days.

(21) Appl. No.: 16/528,783

(22) Filed: Aug. 1, 2019

(65) Prior Publication Data

US 2020/0048957 A1 Feb. 13, 2020

Related U.S. Application Data

(60) Provisional application No. 62/715,469, filed on Aug. 7, 2018.

(51) Int. Cl.
*E06B 7/23* (2006.01)
*E06B 1/70* (2006.01)

(52) U.S. Cl.
CPC ..... *E06B 7/23* (2013.01); *E06B 1/70* (2013.01); *E06B 7/231* (2013.01); *E06B 7/2305* (2013.01)

(58) Field of Classification Search
CPC ..... E06B 1/70; E06B 7/231; E06B 7/2316; E06B 7/2305; E06B 2003/6276
See application file for complete search history.

(56) References Cited

U.S. PATENT DOCUMENTS 2,734,238 A * 2/1956 Clapp ..... E06B 7/231 49/493.1
3,184,808 A * 5/1965 Lyon ..... E06B 7/231 49/493.1
3,242,537 A * 3/1966 Monti ..... F25D 23/087 49/402
3,359,053 A * 12/1967 Hagendoorn ..... F25D 23/082 312/296
3,918,228 A 11/1975 LaBorde
3,974,606 A 8/1976 LaBorde
(Continued)

FOREIGN PATENT DOCUMENTS

DE 102018124170 A1 * 4/2020 ..... E06B 7/2314
EP 1136297 A1 * 9/2001 ..... E06B 7/2305

OTHER PUBLICATIONS

M-D Building Products, #87783 weather stripping, https://www.amazon.com/M-D-Building-Products-87783-Compression/dp/B0006VAMOC, known at least as early as Aug. 1, 2018, 1 pg.
(Continued)

*Primary Examiner* — Marcus Menezes
(74) *Attorney, Agent, or Firm* — Womble Bond Dickinson (US) LLP

(57) ABSTRACT

A weather strip includes a carrier portion and a sealing portion. The carrier portion is formed from a first material that has a first resilience. The carrier is configured to mount to a surface of a frame member of an entryway. The sealing portion is integrally formed with the carrier portion and is formed from a second material. The second material has a second resilience that is greater than the first resilience. The carrier portion and the sealing portion have a constant profile along a length of the weather strip.

13 Claims, 6 Drawing Sheets

(56) References Cited

U.S. PATENT DOCUMENTS 4,204,376 A * 5/1980 Calvert ..... A47K 3/008 52/288.1
4,281,480 A 8/1981 Wemdt
4,330,972 A 5/1982 Sailor
4,430,830 A 2/1984 Sailor
4,439,935 A 4/1984 Langenhorst
4,537,002 A * 8/1985 Ellingson ..... E06B 3/62 49/489.1
4,658,548 A * 4/1987 Gerritsen ..... E06B 7/23 49/489.1
4,856,239 A 8/1989 Elsasser
4,916,864 A * 4/1990 Thompson ..... E06B 7/2305 49/478.1
5,007,203 A * 4/1991 Katrynuik ..... E06B 7/2301 49/482.1
5,058,323 A 10/1991 Gerritsen
5,203,130 A 4/1993 Freelove
5,363,596 A * 11/1994 Kronbetter ..... E06B 7/2305 49/404
5,435,104 A * 7/1995 Dietrich ..... B60J 5/14 49/475.1
5,435,106 A 7/1995 Garries et al.
5,491,940 A 2/1996 Bruchu
5,491,951 A 2/1996 Rigelman
5,511,355 A 4/1996 Dingler
5,528,869 A 6/1996 Boomer et al.
5,634,303 A 6/1997 Ellingson
5,758,458 A 6/1998 Ridge
5,759,680 A 6/1998 Brooks
5,836,118 A 11/1998 Thornton et al.
5,836,134 A * 11/1998 Couto ..... E04F 19/026 52/718.02
5,873,209 A 2/1999 Hagel
5,932,312 A * 8/1999 Steffen ..... E06B 3/62 428/122
5,941,033 A 8/1999 Adams
5,987,843 A 11/1999 Canfield
6,003,277 A 12/1999 Graham et al.
6,024,364 A * 2/2000 Steffen ..... E06B 3/62 277/644
6,050,037 A 4/2000 Gifford
6,125,605 A 10/2000 Young
6,148,582 A 11/2000 Ellingson
6,378,266 B1 4/2002 Ellingson
6,453,631 B1 * 9/2002 Headrick ..... B29C 44/12 49/504
6,557,309 B1 5/2003 Johnson
6,604,334 B2 8/2003 Rochman
6,679,004 B1 1/2004 Olberding
6,680,090 B2 1/2004 Godavarti
6,766,621 B2 7/2004 Reppermund
6,922,969 B1 8/2005 Mina
6,942,225 B2 * 9/2005 Gentemann ..... F16J 15/027 277/641
7,043,883 B1 5/2006 Cederberg
7,160,601 B2 1/2007 Ellingoson
7,765,768 B2 8/2010 Liang et al.
7,930,866 B2 4/2011 Carlson et al.
7,971,400 B2 7/2011 Boldt et al.
8,178,643 B2 5/2012 Edstrom et al.
8,230,652 B2 7/2012 An
8,266,856 B2 7/2012 An
8,371,079 B2 2/2013 An et al.
8,438,808 B2 5/2013 Carlson et al.
8,490,350 B1 7/2013 Greely
8,499,509 B2 8/2013 Sibbett
8,510,996 B2 * 8/2013 Foster ..... E06B 5/164 49/489.1
8,621,794 B2 1/2014 An et al.
8,793,945 B2 8/2014 An et al.
8,857,107 B1 10/2014 Key
9,045,937 B2 * 6/2015 Peck ..... E06B 7/16
9,803,413 B2 10/2017 MacDonald
10,329,834 B2 * 6/2019 Mertinooke ..... B29C 48/12
10,718,151 B2 7/2020 MacDonald et al.
10,801,248 B2 10/2020 MacDonald et al.
2002/0083663 A1 7/2002 Ballantyne
2002/0174610 A1 11/2002 Bennett
2005/0257455 A1 11/2005 Fagan
2006/0123719 A1 6/2006 Careri
2006/0123720 A1 6/2006 Lin
2007/0022699 A1 2/2007 Wang
2007/0028539 A1 2/2007 Peabody
2007/0074469 A1 4/2007 Plagemann
2007/0277455 A1 12/2007 Flanigan
2008/0072506 A1 3/2008 LeGoff
2008/0178541 A1 7/2008 Kerscher
2008/0178553 A1 7/2008 Micho et al.
2009/0000224 A1 1/2009 Kerscher
2009/0173022 A1 7/2009 Wu
2009/0211184 A1 8/2009 Kerscher
2009/0255197 A1 10/2009 Chapman
2010/0192489 A1 8/2010 An
2011/0016796 A1 * 1/2011 Foster ..... E06B 5/164 49/477.1
2011/0138714 A1 6/2011 Van Seters
2013/0263536 A1 10/2013 Peck
2014/0102035 A1 4/2014 Rochman
2015/0240556 A1 * 8/2015 Ellingson ..... E06B 7/2314 49/493.1
2016/0230447 A1 * 8/2016 Grondin ..... E06B 7/2316
2017/0058593 A1 3/2017 Albrecht
2017/0241190 A1 8/2017 MacDonald
2020/0378173 A1 12/2020 MacDonald et al.
2021/0071472 A1 * 3/2021 MacDonald ..... E06B 7/28

OTHER PUBLICATIONS

Pemko, #303AS weather stripping, https://www.assaablovdoorac-cessories.us/en/products/acoustic-kits/standard-perimeter-gasketing/303-s-pg/, known at least as early as Aug. 1, 2018, 1 pg.
Hager, #981S weather stripping, https://hagersupply.com/?page=products&action=view&manufacturerID=61&productID=861S, known at least as early as Aug. 1, 2018, 1 pg.
Simply Conserve, #KC600 weather stripping, https://www.amazon.com/AM-Conservation-Group-KC600-B-Weatherstrip/dp/B008BR9TZ6, known at least as early as Aug. 1, 2018, 1 pg.

* cited by examiner

ENTRYWAY AND WEATHER STRIP FOR THE SAME

CROSS-REFERENCE TO RELATED APPLICATION

This application claims the benefit of, and priority to, U.S. Provisional Patent Application No. 62/715,469, filed Aug. 7, 2018, the entire contents of which are hereby incorporated by reference.

FIELD OF DISCLOSURE

The present disclosure relates to weather strips configured to form a seal to limit infiltration of air and water between a hinged entryway door and the door's frame.

BACKGROUND

Builders and homeowners often use weather strips on exterior door assemblies to limit infiltration of air and water. As shown in FIG. 4, an existing style of weatherseal 10 uses a rigid fin 12 that inserts into a kerf slot 14 in a frame member 16. Other known weatherseals mount to a surface of the frame member 16, or the door itself, using an adhesive or fasteners, such as screws.

Builders and homeowners continue to seek out weather strips that form a good seal, are durable, aesthetically acceptable, and can be relatively easily replaced when worn.

SUMMARY

In accordance with an embodiment of the present disclosure, a weather strip includes a carrier portion and a sealing portion. The carrier portion is formed from a first material that has a first resilience. The carrier is configured to mount to a surface of a frame member of an entryway. The sealing portion is integrally formed with the carrier portion and is formed from a second material. The second material has a second resilience that is greater than the first resilience. The carrier portion and the sealing portion have a constant profile along a length of the weather strip. The carrier portion and the sealing portion may be co-extruded with one another.

In embodiments, the carrier portion may be configured to receive a fastener therethrough to secure the carrier portion to the frame member. The carrier portion may comprise a cover that is configured to conceal a head of a fastener used to secure the carrier portion to a surface of a frame member. The carrier portion may include a mounting wall with the cover being releaseably attached to the mounting wall. The cover may be releaseably attached via a snap fit or a friction fit.

In some embodiments, the carrier portion includes a mounting wall with the cover integrally formed with the mounting wall. The cover may be hinged with the mounting wall by a living hinge.

In certain embodiments, the carrier portion includes a support wall that extends in a direction perpendicular to the mounting wall. The sealing portion may extend from the support wall.

In particular embodiments, the first material is polypropylene or polyvinyl chloride and the second material is ethylene propylene diene terpolymer (EPDM) or a thermoplastic.

In embodiments, the carrier portion is configured to deflect when contacted by a door to form a seal with a surface of the door. The sealing portion may include an attachment leg and a flexible leg. The attachment leg may be joined to the carrier portion and the flexible leg may extend from the attachment leg. The flexible leg may be configured to deform relative to the attachment leg when contacted by a door.

In another embodiment of the present disclosure, an entry way includes a frame member having an outer surface and a first weather strip. The first weather strip may be any weather strip detailed herein including a carrier portion that is configured to mount to the outer surface of the frame member.

In embodiments, the frame member includes an inner surface that is parallel to and offset from the outer surface. The frame member may include a stop portion defined between the inner and outer surfaces. The frame member may include a kerf slot defined in the stop portion adjacent the inner surface. The entryway may include a second weather strip that is mounted within the kef slot of the frame member. The second weather strip may be offset from the first weather strip.

In another embodiment of the present disclosure, a weather strip includes a rigid carrier portion and a flexible sealing portion. The rigid carrier portion is configured to mount to a surface of a frame member of an entryway. The flexible sealing portion is integrally formed with the carrier portion. The sealing portion extends from the carrier portion and is configured to contact and form a seal with a surface of a door.

In embodiments, the carrier portion and the sealing portion have constant profile along a length of the weather strip.

In another embodiment of the present disclosure, a method of manufacturing a weather strip includes extruding a first material through a first die to form a carrier portion and extruding a second material different from the first material through a second die to form a sealing portion. The carrier portion and the sealing portion integrally joined to one another as the first and second materials are extruded. The carrier portion is configured to mount to a surface of a frame member of an entryway. The second material having a resiliency greater than the first material.

Further, to the extent consistent, any of the embodiments or aspects described herein may be used in conjunction with any or all of the other embodiments or aspects described herein.

BRIEF DESCRIPTION OF THE DRAWINGS

Various aspects of the present disclosure are described hereinbelow with reference to the drawings, which are incorporated in and constitute a part of this specification, wherein.

DETAILED DESCRIPTION

Example embodiments of this disclosure are described below and illustrated in the accompanying figures, in which like numerals refer to like parts throughout the several views. The embodiments described provide examples and should not be interpreted as limiting the scope of the disclosure. Other embodiments, and modifications and improvements of the described embodiments, will occur to those skilled in the art and all such other embodiments, modifications and improvements are within the scope of the present disclosure. Features from one embodiment or aspect may be combined with features from any other embodiment or aspect in any appropriate combination. For example, any individual or collective features of method aspects or embodiments may be applied to apparatus, product, or component aspects or embodiments and vice versa. Also, while reference may be made herein to quantitative measures, values, geometric relationships or the like, unless otherwise stated, any one or more if not all of these may be absolute or approximate to account for acceptable variations that may occur, such as those due to manufacturing or engineering tolerances or the like.

Figure 1:
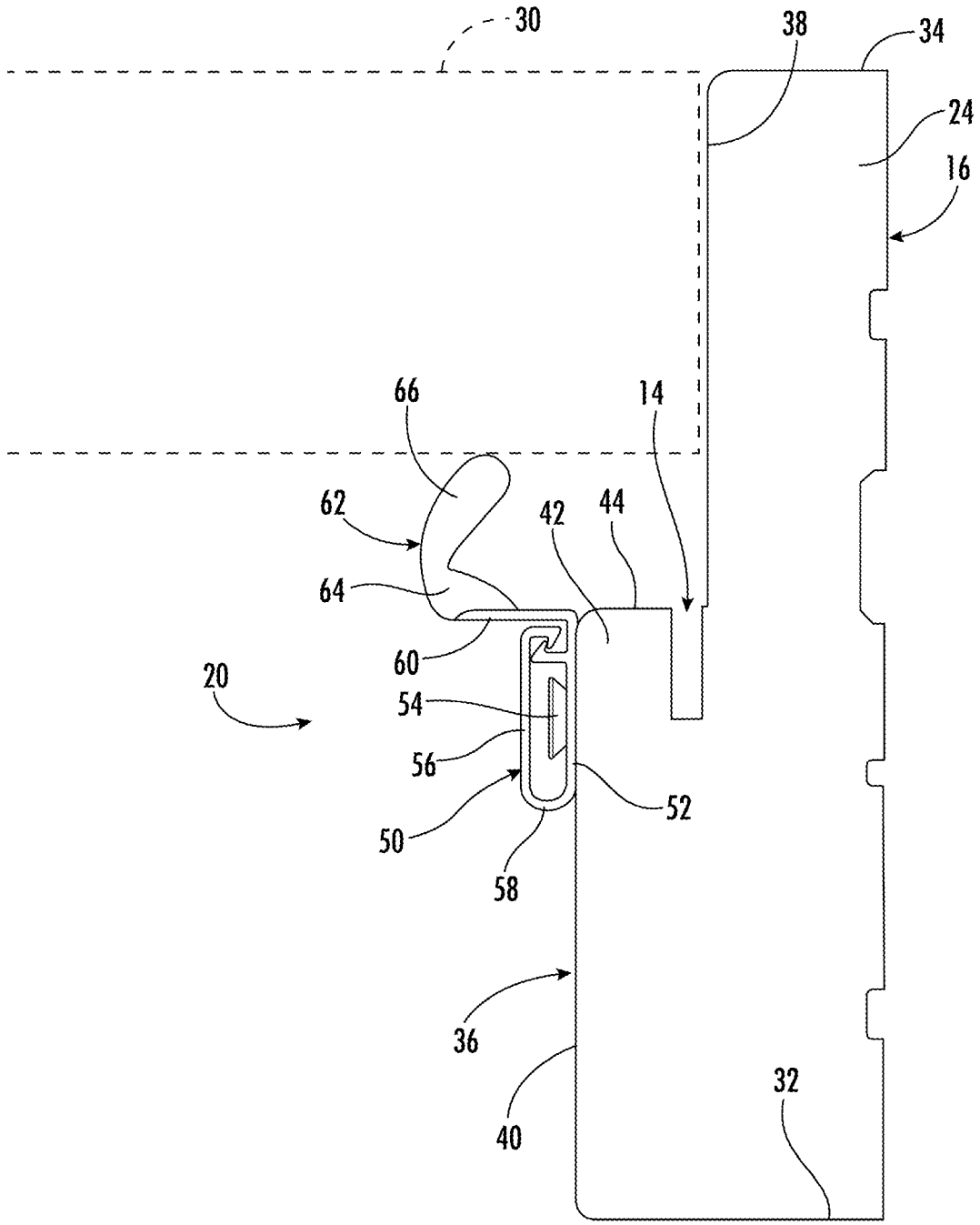
FIG. 1 is a cross-sectional view of a weather strip according to a first embodiment, in a closed position, mounted to a surface of a frame member.

FIG. 1 illustrates a cross section of an example frame member 16 having a first embodiment of a weather strip 20 according to the present disclosure mounted to a surface of the frame member. The frame member 16 is illustrated in the form of a door jamb 24, such as a side jamb that forms one of a pair of vertical jambs that contribute to forming a frame around an entryway door 30. The illustrated door jamb 24 may be positioned along the latch stile of the door 30, and a second door jamb (not shown) may be connected to the door 30 using hinges. The weather strip 20 is not limited to being attached to a latch-side doorjamb, but could also be mounted to a hinge-side doorjamb, a header, or even a threshold. In some, less likely embodiments, the weather strip 20 may be mounted to the door 30. In some embodiments, the weather strip 20 may be used with an in-swing entryway or an out-swing entryway.

The door jamb 24 of the illustrated embodiment has a known profile for an in-swing entryway. The door jamb 24 includes an exterior end 32 typically facing an exterior of a building and an interior end 34 typically facing an interior of the building. A sealing face 36 of the door jamb 24 may include an inner surface 38 and an outer surface 40. Each of the inner surface 38 and outer surface 40 may be substantially planar. The inner surface 38 and the outer surface 40 may be substantially parallel to one another. The inner surface 38 may be offset from the outer surface 40. The outer surface 40 may be formed on a raised stop portion 42. The raised stop portion 42 may be configured for limiting motion of the door 30. The raised stop portion 42 may include the outer surface 40 and an abutment surface 44. A kerf slot 14 can be formed at the base of the raised stop portion 42 and formed into the abutment surface 44. The inner surface 38 may be configured to face an edge of the door 30 when the door is closed. The door jamb 24 should be understood to be substantially consistent in profile along its length. The material forming the door jamb 24 may vary along the length thereof. The door jamb 24 is not limited to the illustrated embodiment. Other door jamb configurations known in the art may also be applicable. For example, the raised stop portion 42 may be omitted, and the sealing face 36 of the door jamb 24 may be substantially planar.

Turning now to the weather strip 20, one skilled in the art will appreciate that the weather strip is understood to potentially extend substantially the entire height of the doorjamb 24. The cross section of the weather strip 20 may be substantially constant along the length thereof. As used herein, "substantially constant" means configured to have a constant cross section in an initial state. The initial state is when the door is open. One skilled in the art will appreciate that the significant length of the weather strip, the resiliency of the sealing portion of the weather strip, and material fatigue in general, will result in some acceptable degree of profile variation within the meaning of "substantially constant."

Figure 2:
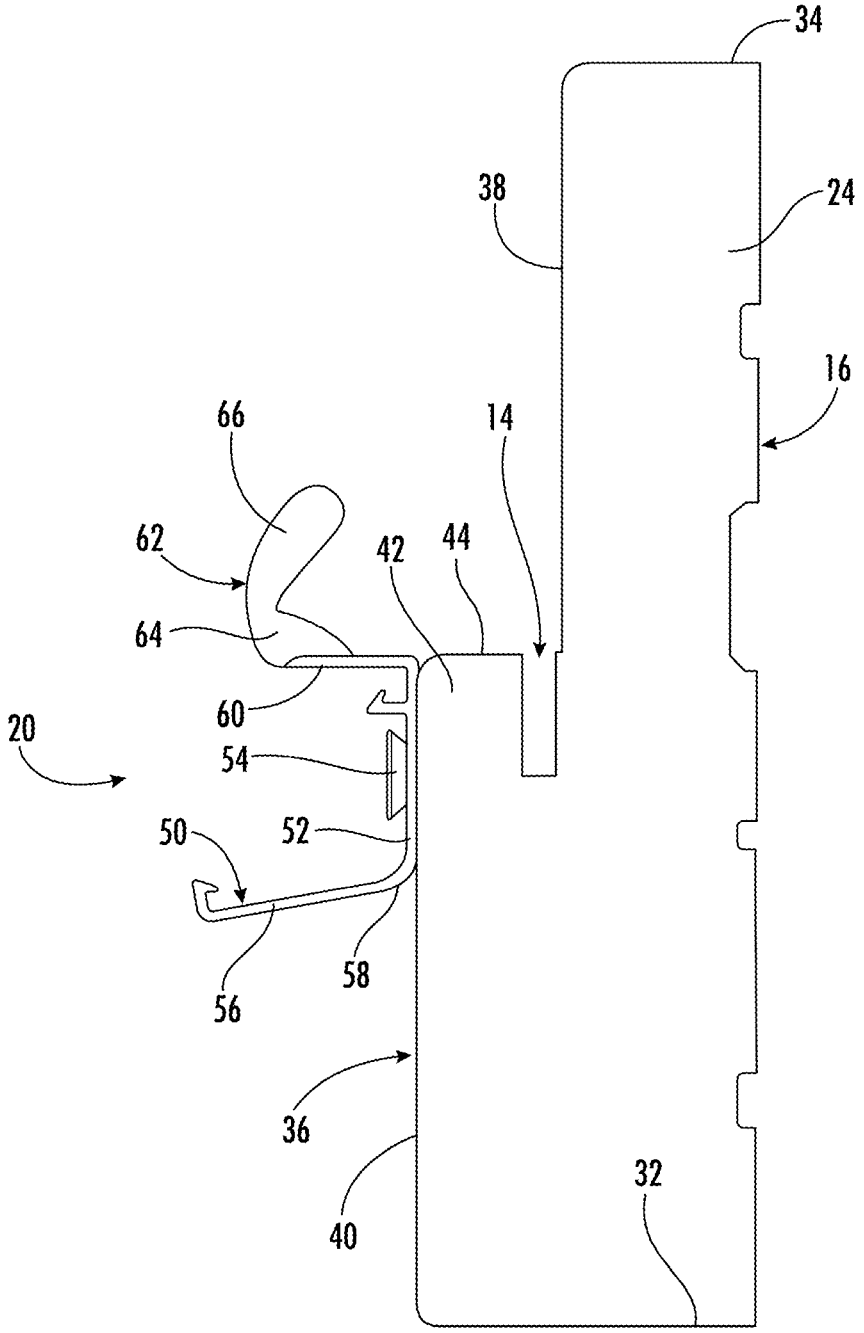
FIG. 2 is a cross-sectional view of the weather strip according to the first embodiment, in an open position.

The weather strip 20 includes a carrier portion 50 formed from a first, relatively rigid, material. Examples of the rigid material include polypropylene or polyvinyl chloride. The carrier portion 50 is configured for being mounted to a surface, such as the outer surface 40 of the frame member 16. Alternatively, the carrier portion 50 could be mounted to the inner surface 38. The carrier portion 50 may include a mounting wall 52 configured to abut door jamb 24. Apertures (not shown) may extend through the mounting wall 52 for accepting fasteners 54, such as screws. The carrier portion 50 may include a cover 56. In the embodiment of FIG. 1, the cover 56 is integral with the mounting wall 52 through a living hinge 58. The cover 56 is configured to bend relative to the mounting wall 52 and enter a closed position, as shown in FIG. 1, for hiding the heads of the fasteners 54. The cover 56 may have a clip arm for forming a snap fit into the closed position. FIG. 2 shows the cover 56 in an open position for when the weather strip 20 is being installed or replaced.

The carrier portion 50 may also include a support wall 60. The support wall 60 may be perpendicular to the mounting wall 52. The support wall 60 is configured to join with a sealing portion 62 of the weather strip 20.

The sealing portion 62 of the weather strip 20 is formed from a second, relatively flexible and resilient material compared to the rigid material of the carrier portion 50. Examples of the second material include ethylene propylene diene terpolymer (EPDM) or thermoplastic elastomer. At least a portion of the sealing portion 62 is configured to deflect when acted upon by the door 30 to form a seal with a surface of the door. The sealing portion 62 may include an attachment leg 64 joining the support wall 60 of the carrier portion 50. The sealing portion 62 may also include a flexible leg 66. The flexible leg 66 may flex, bend, hinge, compress, or otherwise deform relative to the attachment leg 64 when acted upon by the door 30 to form a seal therewith. One of ordinary skill in the art will understand that each of figures accompanying the present disclosure illustrate an initial position of the sealing portion 62 prior to being compressed and/deflected by the door 30 to form a seal.

The weather strip 20 is formed as one integral body with a substantially constant profile using a process of co-extrusion of the first material, that forms the carrier portion 50, substantially simultaneously with the second material, that forms the sealing portion 62. The weather strip 20 is not limited to co-extrusion of two materials but may include co-extrusion of more than two materials. For example, the sealing portion 62 may itself be formed of a foam-like core material and a durable skin material that substantially surrounds the core. In another example, the carrier portion 50 may include additional materials, for creating additional components, such as sealing fins that may help retain or seal the carrier portion 50 with the frame member 16. The co-extrusion process is believed to improve the assembly and/or installation time of the weather strip 20 compared to prior art weatherseals that have two-piece constructions. For example, the carrier portion 50 may be formed by being extruded through a first die (not shown) and the sealing portion 62 may be formed by being extruded through a second die (not shown). The first and second dies may be adjacent one another and may be open to one another such that the carrier portion 50 and the sealing portion 62 are integrally joined to one another while being extruded through the first and second dies respectively.

Figure 3:
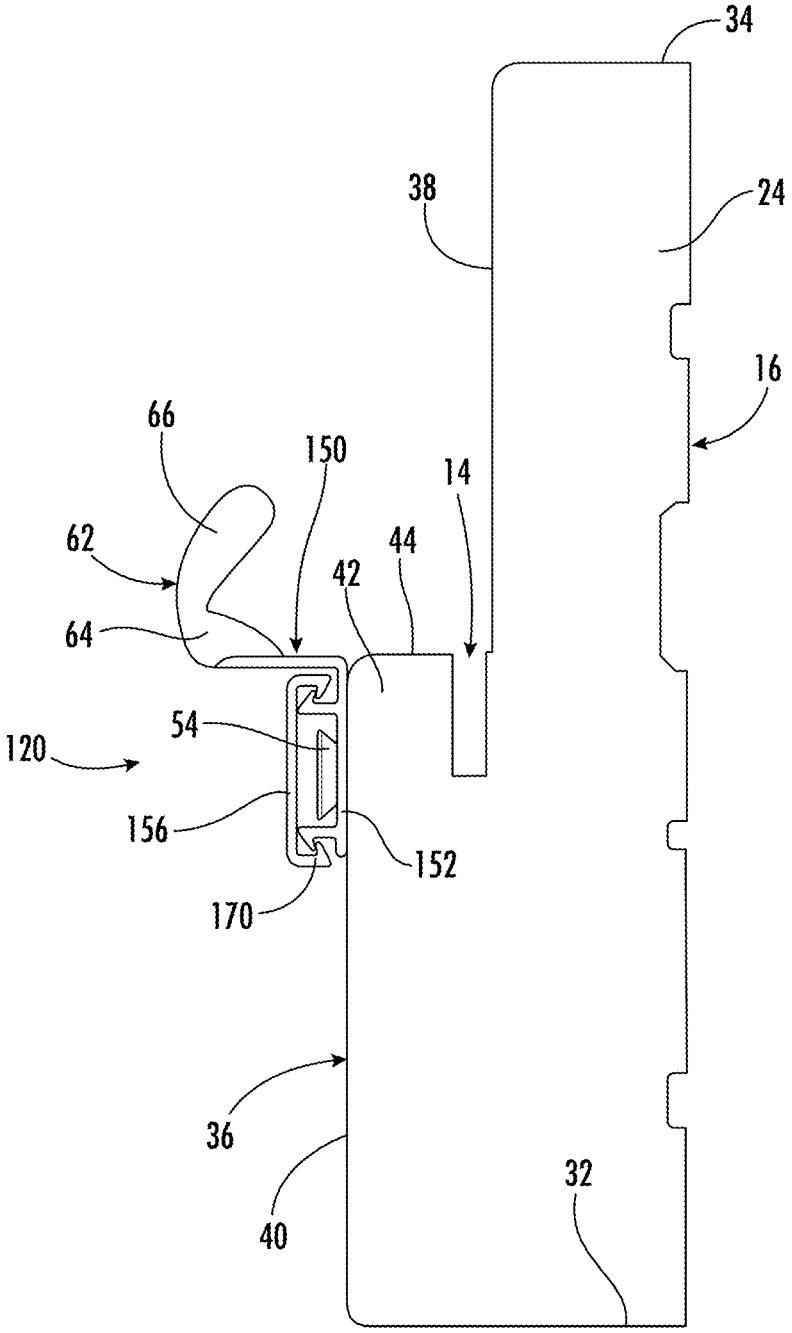
FIG. 3 is a cross-sectional view of a weather strip according to a second embodiment, in a closed position, mounted to a surface of a frame member.

FIG. 3 shows a weather strip 120 according to a second embodiment of the present disclosure. The weather strip 120 includes a cover 156 that is separate and detachable from the mounting wall 152 of the carrier portion 150. The mounting wall 152 and the cover 156 may each include a pair of clip arms 170 configured such that the cover 156 can removably snap into a closed position opposite the mounting wall 152 to hide the heads of the fasteners. Alternatively, the cover 156 may engage the carrier portion 150 with a friction fit to obtain the closed position.

Figure 4:
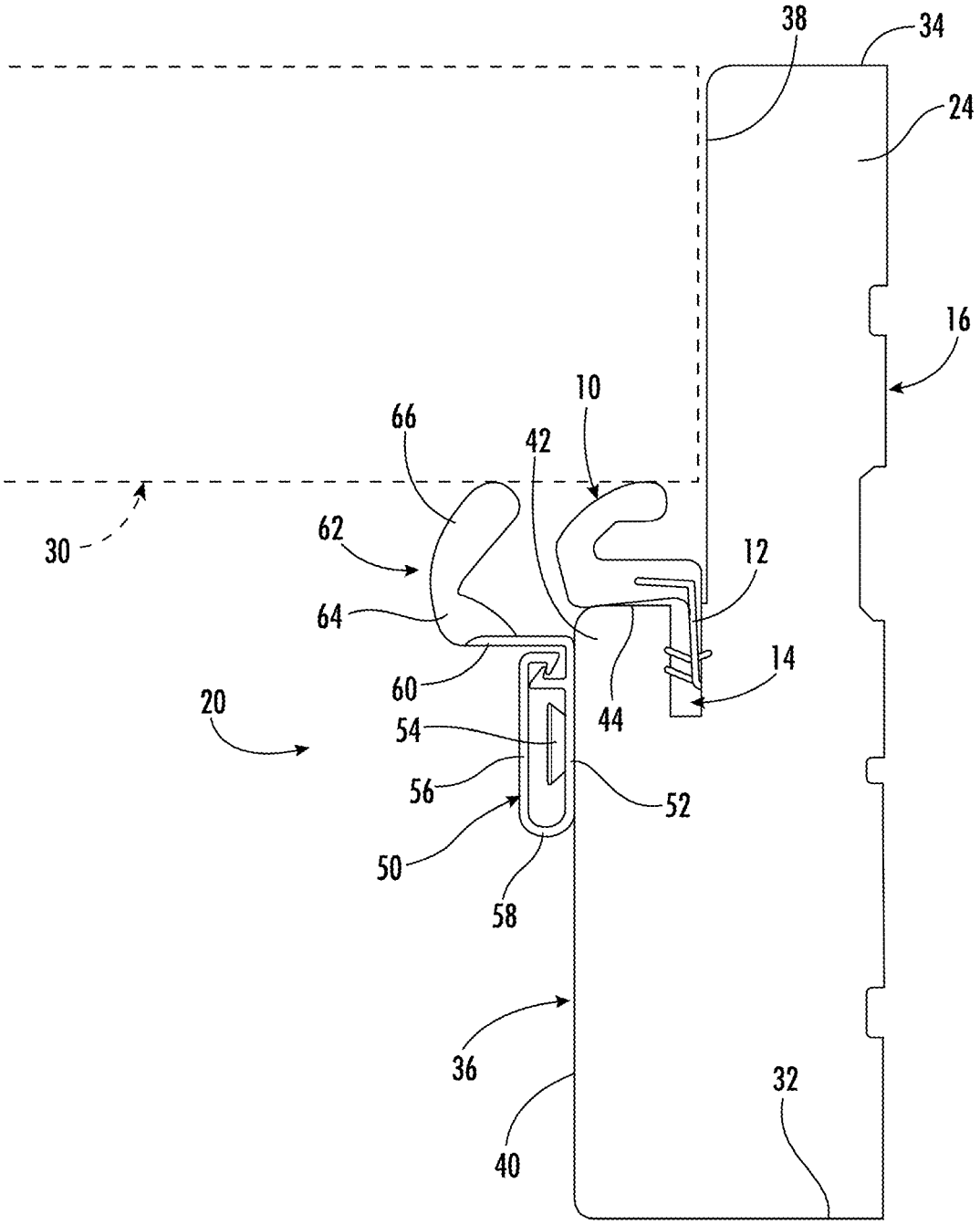
FIG. 4 is a cross-sectional view of the weather strip of FIG. 1 used as a supplemental seal.
Figure 5:
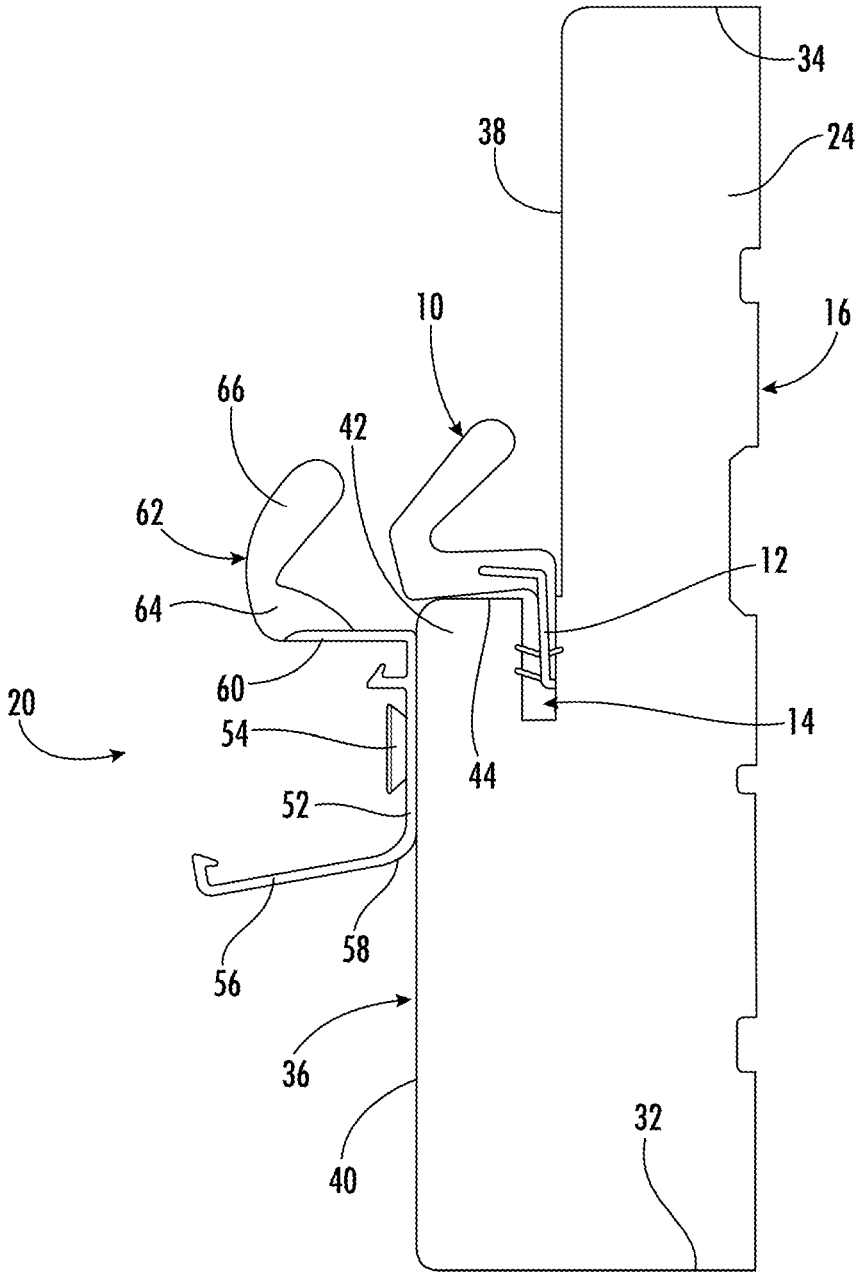
FIG. 5 is a cross-sectional view of the weather strip of FIG. 2 used as a supplemental seal.
Figure 6:
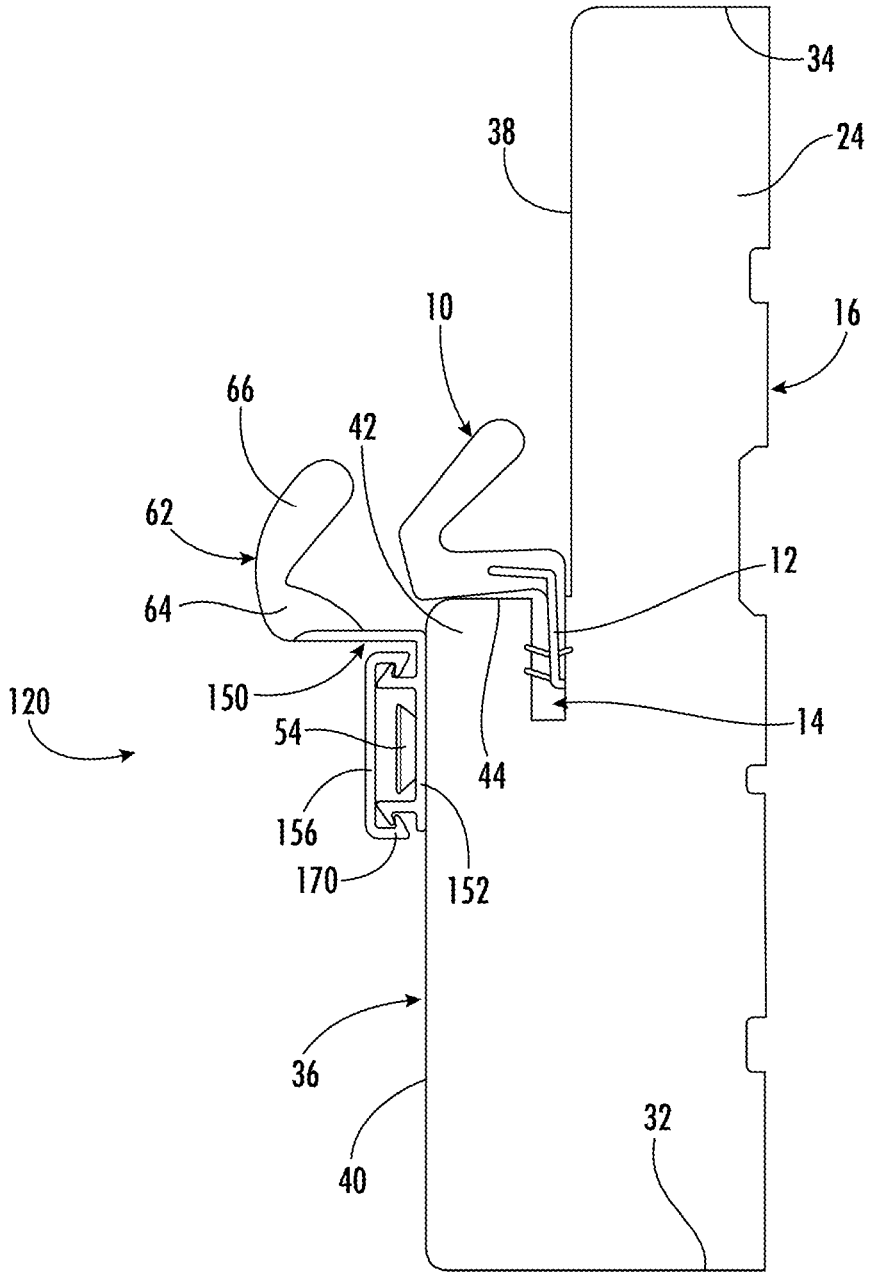
FIG. 6 is a cross-sectional view of the weather strip of FIG. 3 used as a supplemental seal.

The weather strips 20, 120 shown in FIGS. 1-3 may provide a primary structure for sealing against a surface of the door 30, with the goal of limiting infiltration of air and water between the door and the frame member 16. Alternatively, FIGS. 4-6 illustrate another use of the weather strips, 20 and 120 respectively, as articles configured to provide a secondary or supplemental seal along a surface of the door 30, where the weather strips 20, 120 operate in combination with a seal formed by a typical kerf-mounted weatherseal 10.

While several embodiments of the disclosure have been shown in the drawings, it is not intended that the disclosure be limited thereto, as it is intended that the disclosure be as broad in scope as the art will allow and that the specification be read likewise. Any combination of the above embodiments is also envisioned and is within the scope of the appended claims. Therefore, the above description should not be construed as limiting, but merely as exemplifications of particular embodiments. Those skilled in the art will envision other modifications within the scope of the claims appended hereto.

What is claimed:

1. A weather strip comprising:

a carrier portion formed from a first material having a first resilience, the carrier portion comprises a cover and a mounting wall with the cover integrally formed with the mounting wall, the cover hinged with the mounting wall by a living hinge, the carrier portion configured to receive a fastener therethrough to secure the carrier portion to a surface of a frame member of an entryway, the cover configured to conceal a head of the fastener; and a sealing portion integrally formed with the carrier portion and formed from a second material, the second material having a second resilience greater than the first resilience, the carrier portion and the sealing portion having a constant profile along a length of the weather strip.

2. The weather strip according to claim 1, wherein the carrier portion and the sealing portion are co-extruded with one another.

3. The weather strip according to claim 1, wherein the carrier portion comprises a mounting wall, the cover unitarily formed with the mounting wall.

4. The weather strip according to claim 1, wherein the carrier portion includes a support wall that extends in a direction perpendicular to a mounting wall, the sealing portion extending from the support wall.

5. The weather strip according to claim 1, wherein the first material is polypropylene or polyvinyl chloride.

6. The weather strip according to claim 1, wherein the second material is ethylene propylene diene terpolymer (EPDM) or a thermoplastic elastomer.

7. The weather strip according to claim 1, wherein the carrier portion is configured to deflect when contacted by a door to form a seal with a surface of the door.

8. The weather strip according to claim 1, wherein the sealing portion includes an attachment leg and a flexible leg, the attachment leg joined to the carrier portion with the flexible leg extending from the attachment leg, the flexible leg configured to deform relative to the attachment leg when contacted by a door.

9. An entryway, comprising:

a frame member having an outer surface; and a first weather strip according to claim 1, the carrier portion of the first weather strip mounted to the outer surface of the frame member.

10. The entryway according to claim 9, wherein the frame member includes an inner surface parallel to and offset from the outer surface, the frame member including a stop portion between the inner and outer surfaces.

11. The entryway according to claim 10, wherein the frame member includes a kerf slot defined in the stop portion adjacent the inner surface.

12. The entryway according to claim 11, further comprising a second weather strip mounted within the kerf slot of the frame member, the second weather strip offset from the first weather strip.

13. The weather strip according to claim 1, wherein the carrier portion is of unitary construction.

* * * * *